US009273869B1

(12) United States Patent
O'Reilly

(10) Patent No.: US 9,273,869 B1
(45) Date of Patent: Mar. 1, 2016

(54) WOOD BURNING FURNACE

(71) Applicant: Paul D. O'Reilly, Oxford, MA (US)

(72) Inventor: Paul D. O'Reilly, Oxford, MA (US)

( * ) Notice: Subject to any disclaimer, the term of this patent is extended or adjusted under 35 U.S.C. 154(b) by 383 days.

(21) Appl. No.: 13/958,924

(22) Filed: Aug. 5, 2013

(51) Int. Cl.
*F24B 5/00* (2006.01)
*F24B 5/02* (2006.01)

(52) U.S. Cl.
CPC ..... *F24B 5/026* (2013.01); *F24B 5/023* (2013.01); *F24B 5/028* (2013.01)

(58) Field of Classification Search
CPC ..... F24B 5/06; F24B 5/023; F24B 5/028; F24B 5/04; F24B 5/026; F23B 50/06
See application file for complete search history.

(56) References Cited

U.S. PATENT DOCUMENTS

| | | | | |
|---|---|---|---|---|
| 4,559 | A | 6/1846 | Slades | |
| 38,828 | A | 6/1863 | Hunt | |
| 89,141 | A | 4/1869 | Goodfellow | |
| 204,406 | A | 5/1878 | White | |
| 327,650 | A | 10/1885 | Boyd | |
| 548,079 | A | 10/1895 | Miller | |
| 552,911 | A | 1/1896 | Knauss | |
| RE11,623 | E | 7/1897 | McLean | |
| 713,066 | A | 11/1902 | Cooper | |
| 719,827 | A | 2/1903 | Matthews | |
| 801,723 | A | 10/1905 | Lange | |
| 843,103 | A | 2/1907 | Roell | |
| 1,044,724 | A | 11/1912 | Atteberry | |
| 1,954,923 | A | 4/1934 | Eichhorn | |
| 2,129,202 | A * | 9/1938 | Drewry | F24F 3/12 165/236 |
| 2,227,689 | A | 1/1941 | Agricolo | |
| 2,352,057 | A | 6/1944 | Wingert | |
| 2,454,104 | A | 11/1948 | Eggert | |
| 2,461,068 | A | 2/1949 | Lockwood | |
| 2,469,639 | A | 5/1949 | Franklin | |
| 2,564,713 | A | 8/1951 | Miles | |
| 2,607,335 | A | 8/1952 | Harding | |
| 2,797,874 | A | 7/1957 | Harding | |
| 3,168,088 | A | 2/1965 | Martin et al. | |
| 3,765,823 | A | 10/1973 | Kawabata et al. | |
| 4,047,515 | A | 9/1977 | Daniel | |
| 4,052,136 | A | 10/1977 | Ulricksen | |
| 4,154,212 | A | 5/1979 | Wilkinson | |
| 4,182,304 | A | 1/1980 | Mele | |
| 4,194,487 | A | 3/1980 | Cadwallader et al. | |
| 4,326,495 | A | 4/1982 | Millar | |
| 4,350,141 | A | 9/1982 | Miller | |
| 4,360,000 | A | 11/1982 | Down | |
| 4,362,146 | A | 12/1982 | Schuller | |
| 4,432,335 | A | 2/1984 | Kilham | |
| 4,434,782 | A | 3/1984 | Traeger | |
| 4,466,358 | A | 8/1984 | Christian | |
| 4,484,530 | A | 11/1984 | Goetzman | |
| 4,510,917 | A | 4/1985 | Runquist | |
| 4,630,553 | A | 12/1986 | Goetzman | |
| 4,635,899 | A | 1/1987 | Eshleman | |

(Continued)

*Primary Examiner* — Alfred Basichas
(74) *Attorney, Agent, or Firm* — John P. McGonagle

(57) ABSTRACT

A wood burning furnace providing, in sequential connection, an air box, a fire box with a wood storage box/primary combustion chamber and a secondary combustion chamber separated by an ash grate, a heat exchanger, an exhaust manifold, and a smoke stack. The air box has an input port attached to an intake air blower. The air box also has two dampers, a first damper providing controlled access to an updraft exhaust pipe connected to the smoke stack. The second damper provides controlled access from the intake blower through the air box to the wood storage box/primary combustion chamber.

1 Claim, 16 Drawing Sheets

(56) References Cited

U.S. PATENT DOCUMENTS

| | | | |
|---|---|---|---|
| 4,677,965 | A | 7/1987 | Duerichen |
| 4,856,491 | A | 8/1989 | Ferguson et al. |
| 5,462,043 | A | 10/1995 | Rose et al. |
| 5,983,885 | A | 11/1999 | Jarvi |
| 6,213,116 | B1 | 4/2001 | Swainson |
| 6,397,833 | B1 | 6/2002 | Jarvi |
| 6,688,302 | B2 | 2/2004 | Henry et al. |
| 6,817,354 | B2 | 11/2004 | Laitinen |
| 7,066,170 | B1 | 6/2006 | Atemboski et al. |
| 7,216,645 | B2 | 5/2007 | Hebry et al. |
| 7,325,541 | B2 | 2/2008 | Marcakis |
| 8,161,959 | B1 | 4/2012 | O'Reilly |
| 2008/0035137 | A1 | 2/2008 | Federico |
| 2008/0223266 | A1 | 9/2008 | Brazier et al. |

* cited by examiner

WOOD BURNING FURNACE

BACKGROUND OF THE INVENTION

This invention relates to furnaces, and more particularly to wood-burning, downdraft furnace.

A simple wood-burning furnace usually comprises a metal box having a door for loading wood, an air inlet control system (often part of the door) for controlling the amount of combustion air admitted into the box and an exhaust flue for directing exhaust gases from the box. Such simple wood burning stoves tend to be inefficient because unburned vapors and particulates pass out of the exhaust flue. Admitting more combustion air may reduce the amount of unburned vapors and particulates passed out of the exhaust flue, but then the fire tends to burn too hot and too fast.

A solution to such problems is to make the wood-burning furnace a downdraft furnace. Downdraft furnaces promote "secondary combustion." Primary combustion is throttled by controlling the amount of combustion air. The unburned vapors and particulates are then mixed with heated air in a secondary combustion to burn such vapors and particulates and thereby recover more heat and reduce pollution.

"Downdraft" furnaces are known in the prior art. A downdraft furnace, also known as a "magazine" furnace, is comprised of an air supply, a wood storage section, a primary combustion chamber and ash grate, a secondary combustion chamber, a heat exchanger, an exhaust manifold, and an exhaust flue, i.e., smoke stack. Combustion is initiated at the top of the wood storage section flowing downward to the bottom of the wood storage in a primary combustion chamber. The wood combustion results in gasification of the wood fuel and combustion of the gas and residual particulates in a secondary combustion chamber resulting in a very high temperature combustion, i.e., typically 2000 degrees F. The heated air from combustion passes through the heat exchanger and exits the exhaust manifold to the smoke stack. In theory, downdraft furnaces should be able to provide complete combustion, however practical applications of the downdraft principles have resulted in incomplete combustion and poor heat transfer from fuels. The main problem arises from the difficulty of providing the proper amount of air to the combustion process of the furnace's fuel.

SUMMARY OF THE INVENTION

The present invention overcomes the limitations of prior art downdraft furnaces by providing a unique approach to providing the proper amount of air to the combustion process. The present invention is a modification of applicant's U.S. Pat. No. 8,161,959, issued Apr. 24, 2012, for a "Wood Burning Furnace" (hereinafter the '959 patent). Both the present invention and the '959 furnace provide in sequential connection an air box, a fire box with a wood storage box/primary combustion chamber and a secondary combustion chamber separated by an ash grate, a heat exchanger, an exhaust manifold, and a smoke stack. Both have an air box having an input port attached to an intake air blower. Both air boxes also have two dampers. The '959 furnace has a first damper (thermostatically controlled) providing controlled access to an updraft exhaust pipe connected to the smoke stack; and a second damper providing controlled access to the wood storage box/primary combustion chamber. This arrangement, although effective for producing heat, has drawbacks relating to loading wood into the primary combustion chamber and power failures. The '959 damper arrangement has a tendency to generate smoke from the combustion chambers back into the ambient area about the furnace. The present invention overcomes this problem by moving the second damper from an aperture Leading from the air box into the wood storage box/primary combustion chamber to the input port attached to an intake air blower. When the door leading into the primary combustion chamber is opened for whatever reason, the second damper seals off the air input port, and opens the first damper to the updraft exhaust pipe connected to the smoke stack. Residual smoke then rises into the air box from the primary combustion chamber and out through updraft exhaust pipe. When there is a power failure, both air box dampers close, and smoke is vented through the exhaust manifold and smoke stack.

In normal operation with the door leading into the primary combustion chamber closed air is brought into the air box and forced downwardly through the aperture between the air box and primary combustion chamber through the wood storage box/primary combustion chamber containing a wood fire with a bed of coals being fed with fresh fuel from above. The wood fire releases smoke, particulates, combustibles and other volatile gases through the ash grate into the secondary combustion chamber. The wood combustion in the primary combustion chamber results in gasification of the wood fuel through the ash grate and combustion of the gas and residual particulates in the secondary combustion chamber resulting in a very high temperature combustion.

The air provided for combustion of the starting fuel material is forced through the hot coals of the burned fuel, pushing vapors and particulates within the air to the secondary combustion chamber. Combustion of the particulates, gases and smoke continues within the secondary combustion chamber. Heated air from the secondary combustion chamber passes through the heat exchanger and exits through the manifold to the smoke stack. The air box second damper controls the amount of air from the blower into the air box and into the combustion chambers, thereby controlling the level of combustion and heat generated by the furnace.

The present invention is unique from prior art downdraft furnaces in that the present invention dampers are contained in a self-contained air box separated from and positioned above the furnace body. The invention air blower feeds directly into the air box and not the stove body. The air blower may be manually controlled or controlled with a thermostat.

These together with other objects of the invention, along with various features of novelty, which characterize the invention, are pointed out with particularity in the claims annexed hereto and forming a part of the disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
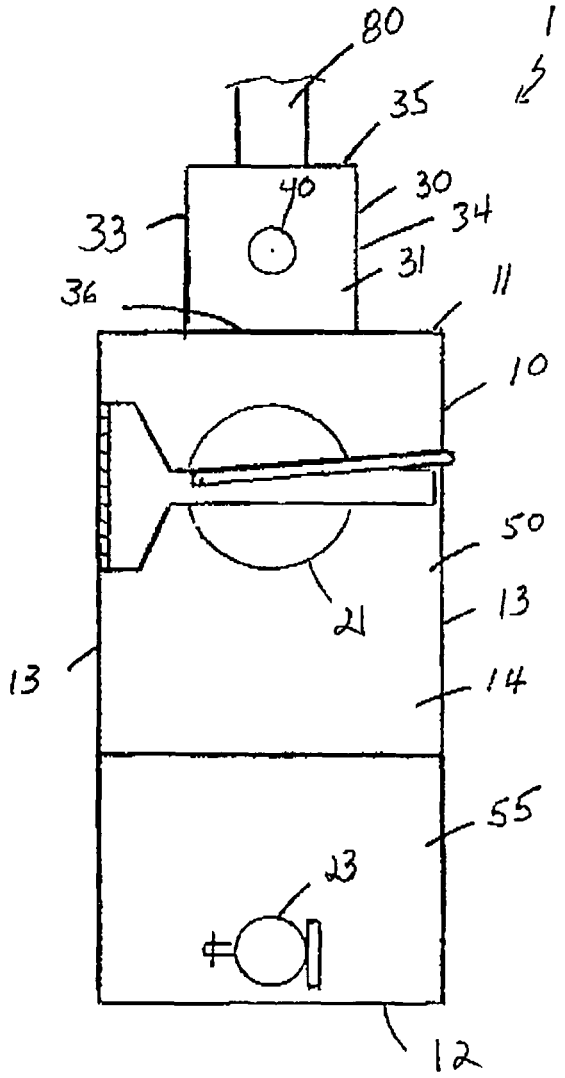
FIG. 1 is a front view of the invention furnace.
Figure 2:
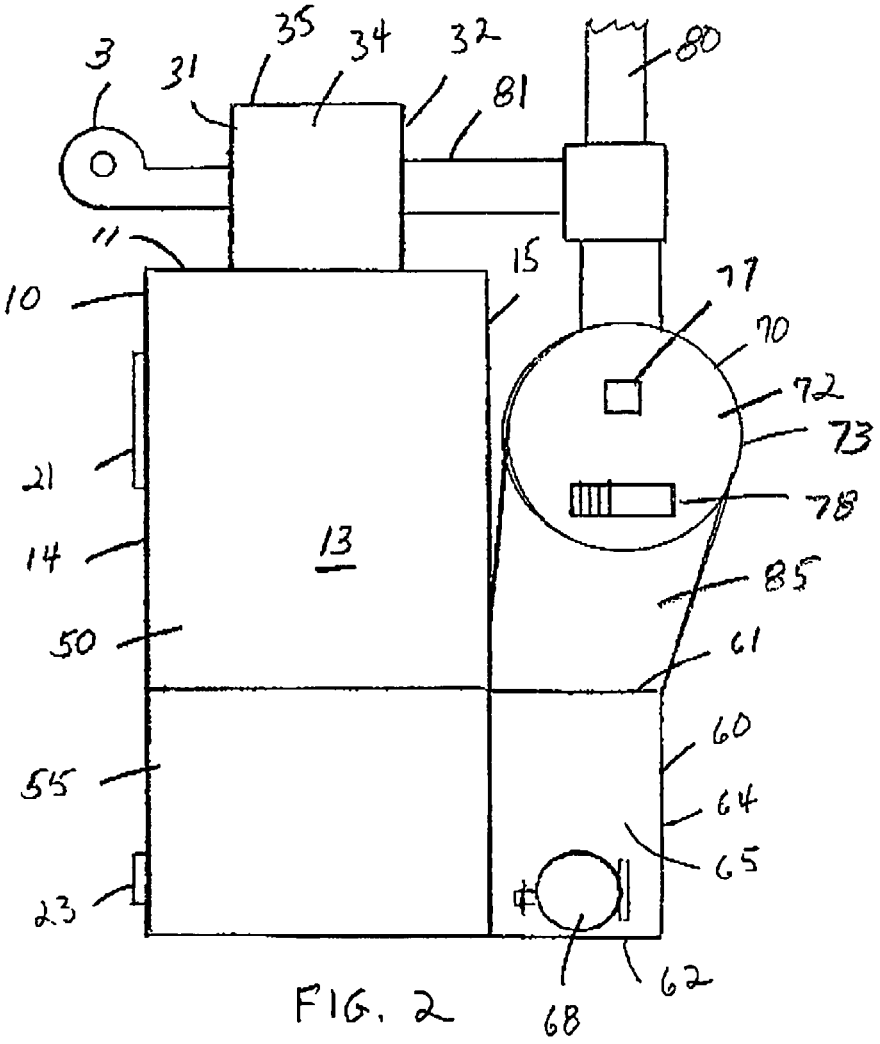
FIG. 2 is a side view thereof.
Figure 3:
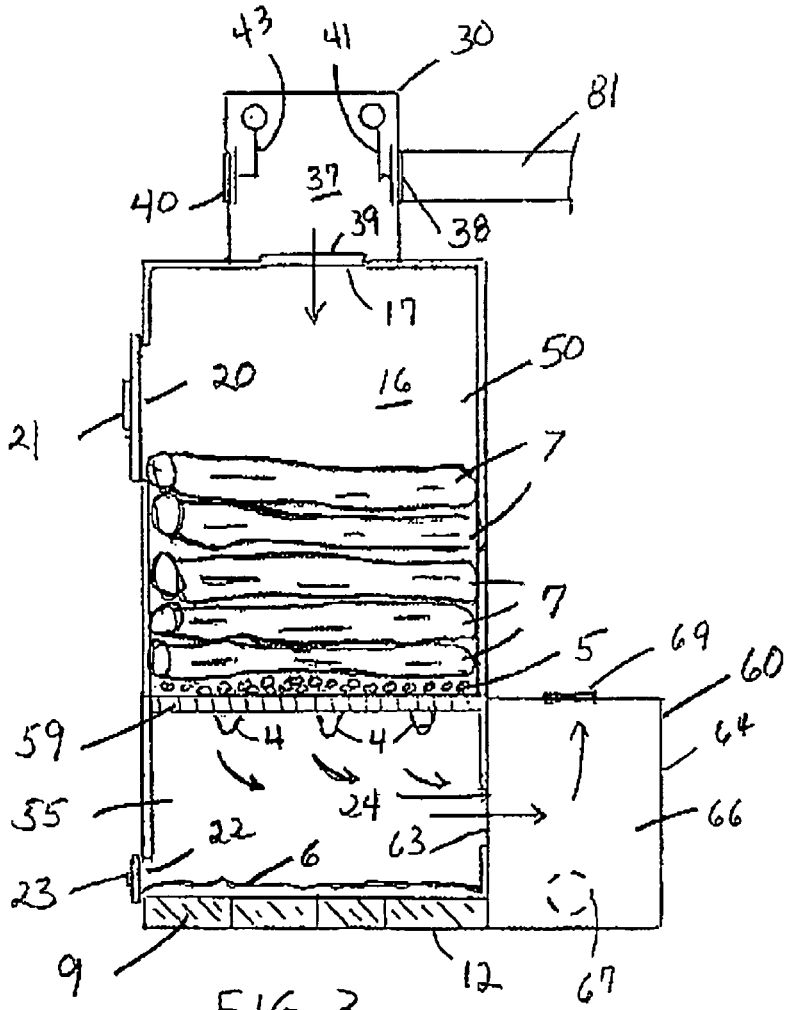
FIG. 3 is a partial side interior view, partly in section, of the invention furnace.
Figure 4:
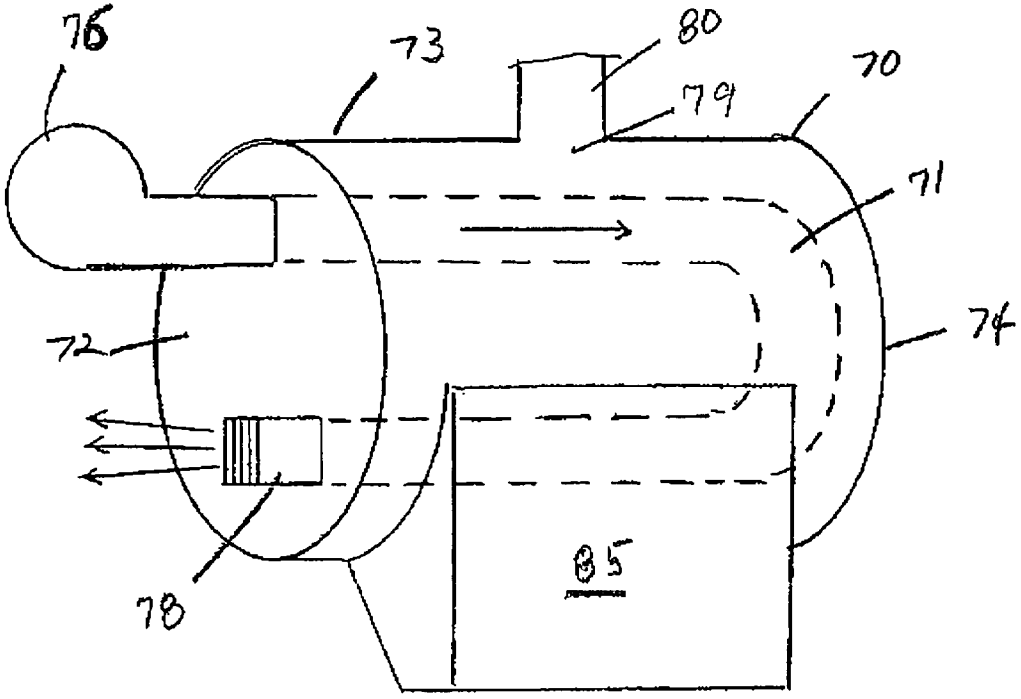
FIG. 4 is a side view, partly in section, of the furnace heat exchanger.
Figure 5:
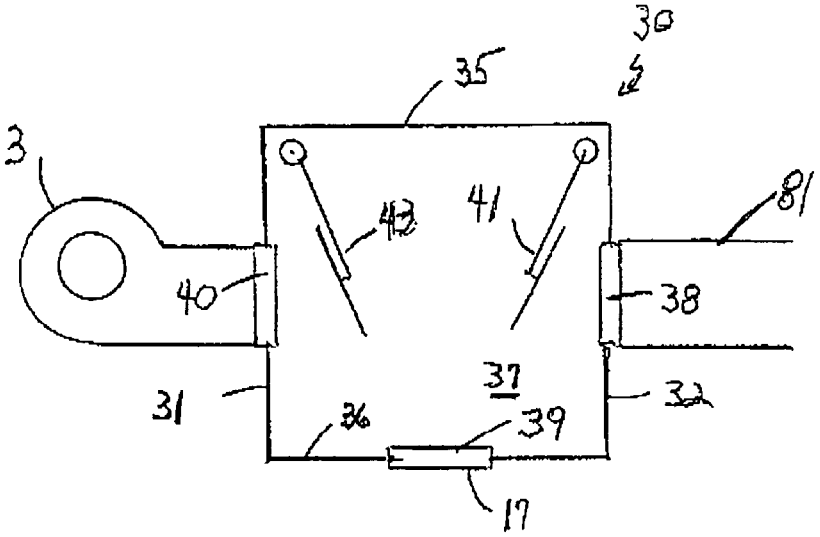
FIG. 5 is a side sectional view of the air box.
Figure 6:
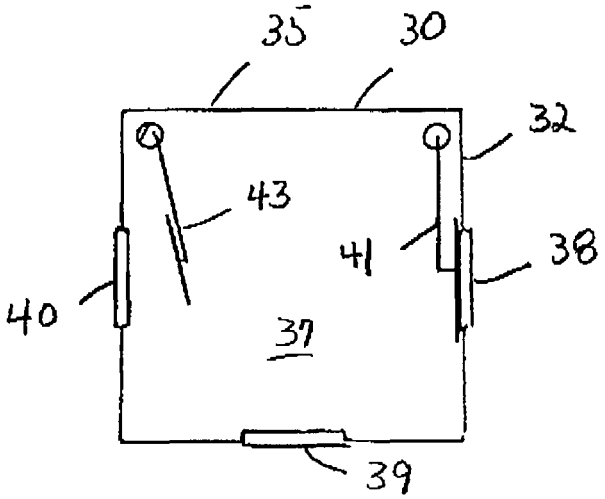
FIG. 6 is a side sectional view of the air box configuration when the firebox front door is closed.
Figure 7:
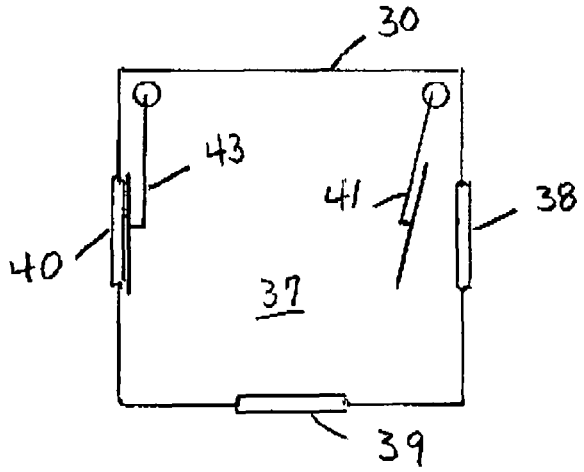
FIG. 7 is a side sectional view of the air box configuration when the firebox front door is open.

Referring to the drawings in detail wherein like elements are indicated by like numerals, there is shown a wood burning furnace 1 constructed according to the principles of the present invention. The furnace 1 has a firebox 10 having a top 11, a bottom 12, two opposite sides 13, a front 14, and a rear 15, said top, bottom, sides, front and rear defining a firebox interior 16. The furnace 1 is further comprised of an air box 30 connected to the firebox top 11, a manifold chamber 60 connected to the firebox rear 15 near to the firebox bottom 12. The manifold chamber 60 is attached to a heat exchanger 70 with an outlet to a furnace exhaust flue 80.

The air box 30 has a generally rectangular shape, but other invention embodiments may have different shapes. The air box 30 has a front wall 31, rear wall 32, a left side wall 33, a right side wall 34, a top 35, and a bottom 36, said walls, top and bottom defining a hollow air box interior 37. The air box bottom 36 is attached to the firebox top 11. The air box 30 has a plurality of apertures formed therein. A first aperture 38 is formed in the air box rear wall 32. The first aperture 38 opens into a hollow, up draft exhaust pipe 81 fluidly terminating into the furnace exhaust flue 80. A second aperture 39 is formed in the air box bottom 36. The firebox body top 11 has a corresponding aperture 17 providing fluid access from the air box interior 37 into the firebox body 10. A third aperture 40 is formed in the air box front wall 31. The third aperture 40 is connected to a combustion air blower 3 and provides access for forced air from the blower 3 into the air box interior 37.

The air box interior 37 has a first damper 41 pivotally connected therein, said first damper operationally adapted to fit over the air box first aperture 38 in the rear wall. The first damper 41 is connected to a first lever 42 pivotally attached outside the air box to the air box right side wall 34, near to the air box top 35. The first lever is connected to a linkage apparatus 90.

The air box interior 37 has a second damper 43 pivotally connected therein, said second damper operationally adapted to fit over the air box third aperture 40. The second damper 43 is connected to a second lever 44 pivotally attached outside the air box to the air box right side wall 34, near to the air box top 35. The second lever 44 is also connected to said linkage apparatus.

The firebox interior 16 is vertically divided into an upper segment 50 and a lower segment 55 divided by a horizontal grate assembly 59. The firebox interior upper segment 50 is defined by the firebox top 11 and the grate assembly 59, said upper segment 50 comprising a wood storage compartment and a primary combustion chamber. The firebox body 10 has a first front aperture 20 opening into the firebox interior upper segment 50, said first front aperture 20 sealable by means of a first door 21. The first front aperture 20 provides means for inserting fuel logs 7 into the interior upper segment 50.

The firebox interior lower segment 55 is defined by the grate assembly 59 and the firebox bottom 12, said lower segment 55 comprising a secondary combustion chamber. The firebox body 10 has a second front aperture 22 opening into the firebox interior lower segment 55 sealable by means of a second door 23. The second front aperture 22 provides means for removal of ash 6. The firebox interior lower segment 55 is lined with firebrick 9. The firebricks 9 may have various arrangements to provide variations in heat control. The firebox body rear 15 has a rear aperture 24 formed therein near to the firebox bottom 12 opening from the firebox interior lower segment 55 into the manifold chamber 60, which interconnects the secondary combustion chamber with the furnace heat exchanger 70.

The manifold chamber 60 has a top 61, bottom 62, open front 63, rear 64, and two opposite sides 65, said top, bottom, front, rear, and sides defining a manifold chamber interior 66. The manifold chamber open front 63 coincides with the secondary combustion chamber rear aperture 24. One manifold chamber side 65 has a side aperture 67 sealable by means of a door 68. The manifold chamber side aperture 67 provides access into the manifold chamber interior 66 for removal of residual ash. The manifold chamber top 61 has a top aperture 69 providing hot air interconnection with the furnace heat exchanger 70.

The furnace heat exchanger 70 is comprised, in this invention embodiment, has a sepentine hollow pipe arrangement 71. The heat exchanger 70 has a front 72 from which a cylindrical side wall 73 extends horizontally to a rear 74, said front, side wall and rear defining a heat exchanger interior 75. The pipe arrangement 71 is contained within the heat exchange interior 75. The heat exchange front 72 contains a first aperture 77 and a second aperture 78 below said first aperture. The pipe 71 opens at the first aperture 77 and extends through the heat exchange interior 75 terminating at and opening out to the second aperture 78. A second blower 76 is attached to said first aperture 77 blowing air through the pipe 71 and out through the second aperture 78. The cylindrical side wall 73 has an aperture 79 formed centrally at its vertical highest point, said aperture opening into the exhaust flue 80. The heat exchange 70 has an open connector section 85 interconnecting said manifold chamber 60 with the heat exchange interior 75. Wherein heated air from the secondary combustion chamber 55, passes through the manifold interior 66, through the manifold top aperture 69, through the heat exchange connector section 85 into the heat exchange interior 75 across the pipe 71 and out through the flue 80. The air in the pipe from the second blower 76 is heated and exits the second aperture 78 as heated air.

Primary combustion of the fuel logs 7 take place in the firebox interior upper segment 50 from the top fuel logs to bottom fuel logs adjacent the grate assembly 59. Air from the air combustion air blower 3 through the air box 30, through the air box second aperture 39 into the firebox interior upper segment 50 and down through the wood storage compartment channels combustion of the fuel logs 7 toward the bottom fuel logs. Combustible gases 4 flow downward through the grate assembly 59 from the primary combustion chamber 50 into the secondary combustion chamber 55 below the grate assembly 59.

In operation air is forced into the air box 30 by the combustion air blower 3 and downwardly through the second air box aperture 39 into and through the wood storage compartment/primary combustion chamber 50 containing the wood fire with a bed of coals 5 on the grate assembly 59 being fed with fresh fuel from above. The fire releases smoke, particulates, combustibles and other volatile gases 4 through the grate assembly 59 into the secondary combustion chamber 55. The air provided for combustion of the starting fuel material is forced through the hot coals 5 of the burned fuel, pulling vapors 4 and particulates within the air to the secondary combustion chamber 55. Combustion of the particulates, gases and smoke continues within the secondary combustion chamber 55 increasing temperatures to approximately 2000° F. The heated air from secondary combustion passes into the manifold chamber interior 66, out through the manifold top aperture 69, through the heat exchange hollow connector 85, into the heat exchange interior 75, across the pipe 71 and out the flue exhaust 80. The second air blower 76 forces air through the pipe 71, which piped air is heated by the heated air within the heat exchange interior 75. The second blower 76 pushes the resultant heated air within the pipe 71 out the second aperture 78 into the ambient area.

Figure 8:
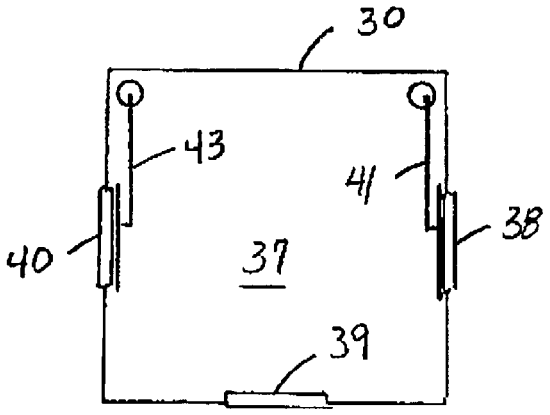
FIG. 8 is a side sectional view of the air box configuration when all power to the furnace is off.
Figure 9:
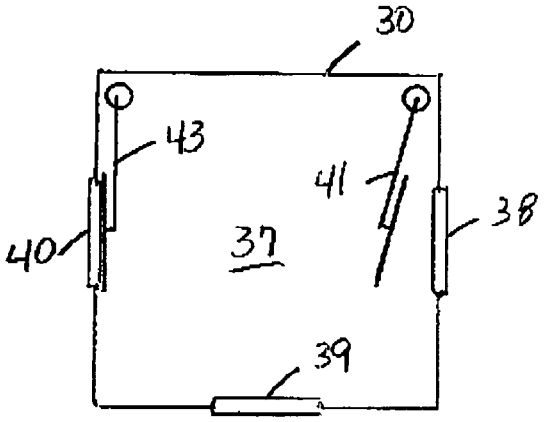
FIG. 9 is a side sectional view of the air box configuration when the firebox front door is open to add wood.
Figure 10:
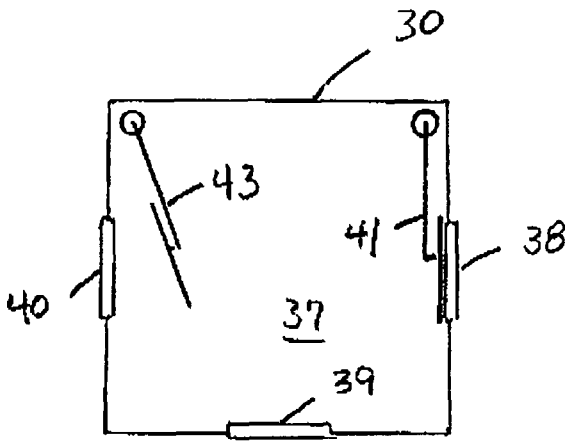
FIG. 10 is a side sectional view of the air box configuration for maximum heat.
Figure 11:
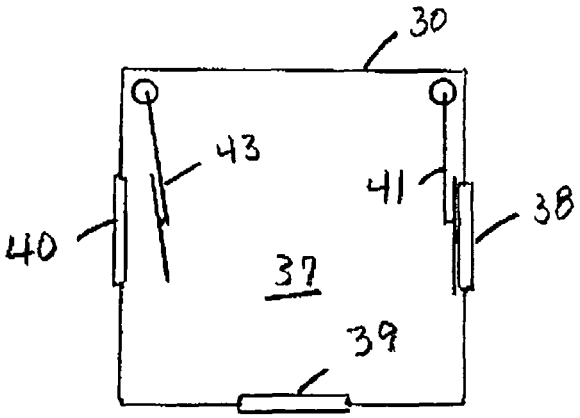
FIG. 11 is a side sectional view of the air box configuration for less than maximum heat.
Figure 12:
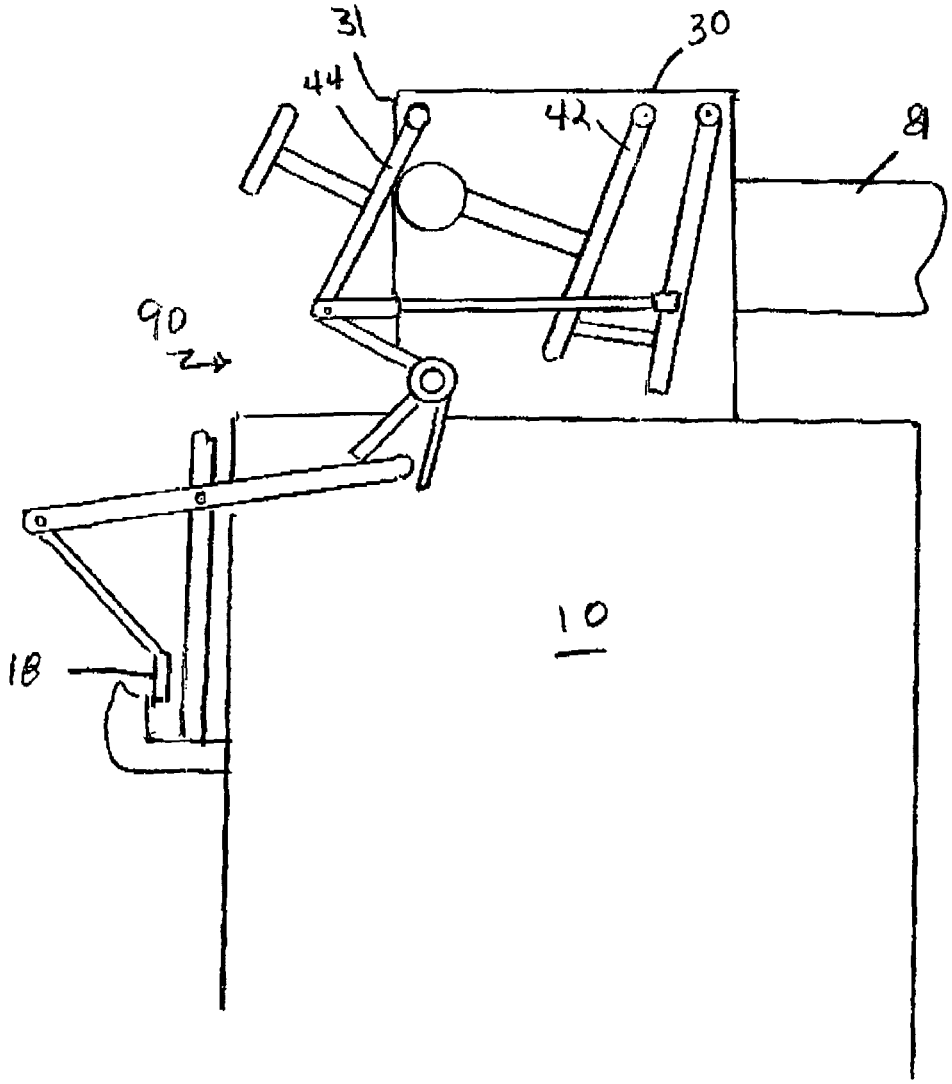
FIG. 12 is a furnace side view, partly in section, with the air box—front door linkage set for the air box configuration of FIG. 7.
Figure 13:
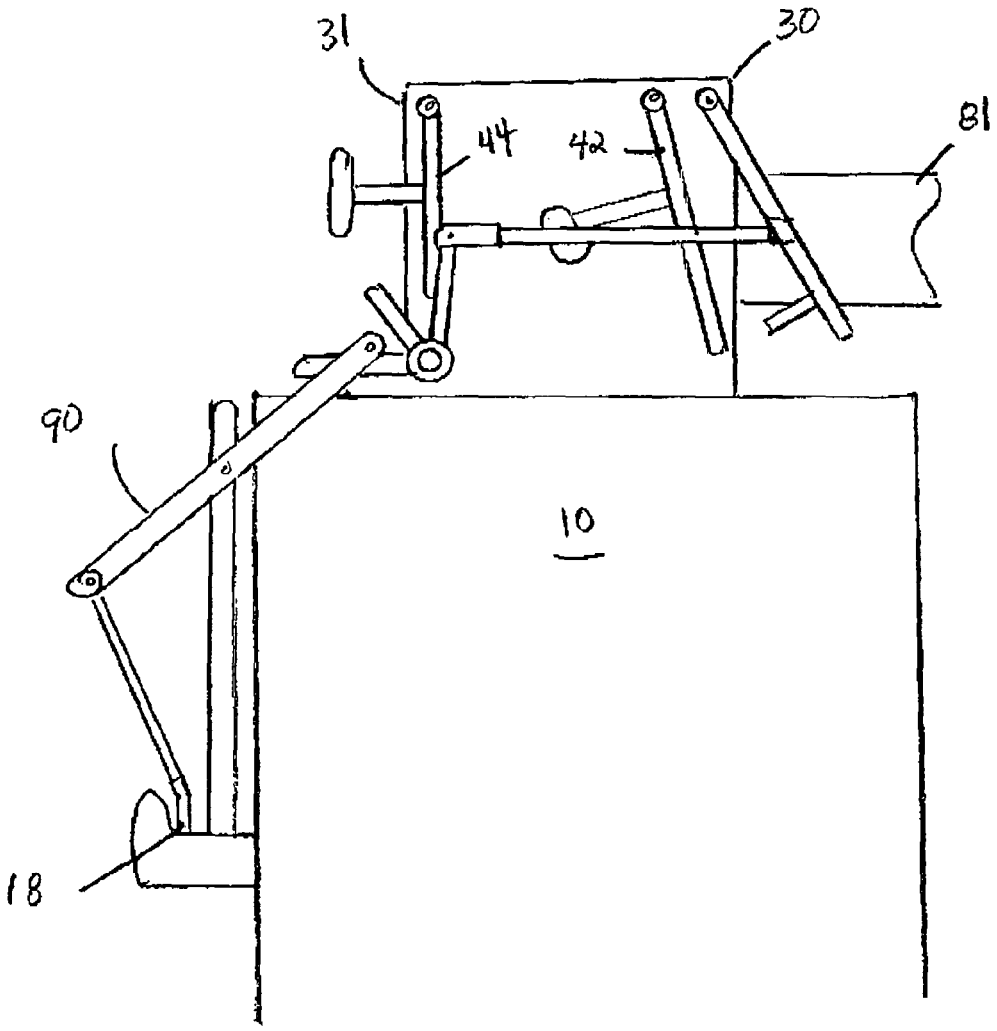
FIG. 13 is a furnace side view, partly in section, with the air box—front door linkage set for the air box configuration of FIG. 6.
Figure 14:
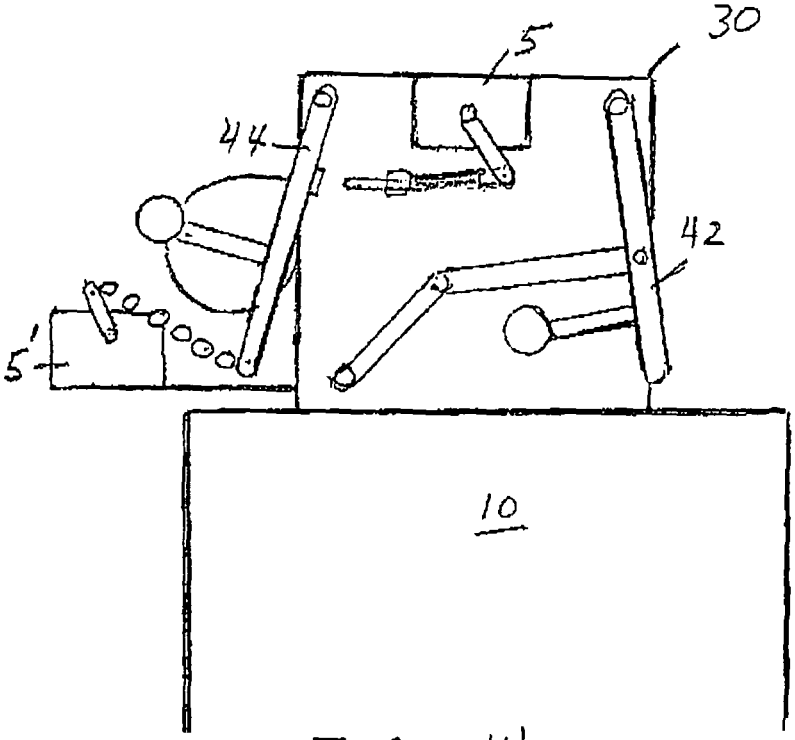
FIG. 14 is a furnace side view, partly in section, with the air box—front door linkage set for the air box configuration of FIG. 8.
Figure 15:
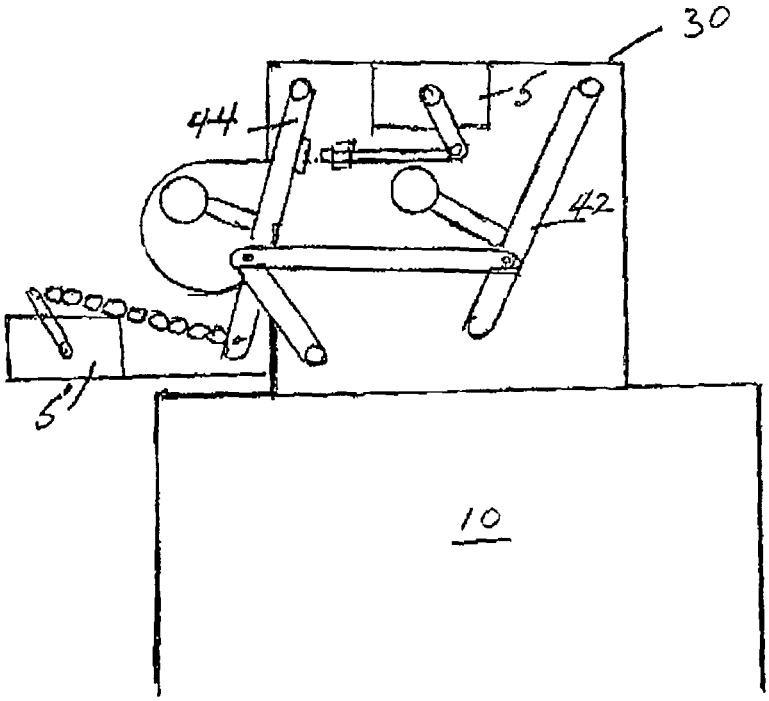
FIG. 15 is a furnace side view, partly in section, with the air box—front door linkage set for the air box configuration of FIG. 9.
Figure 16:
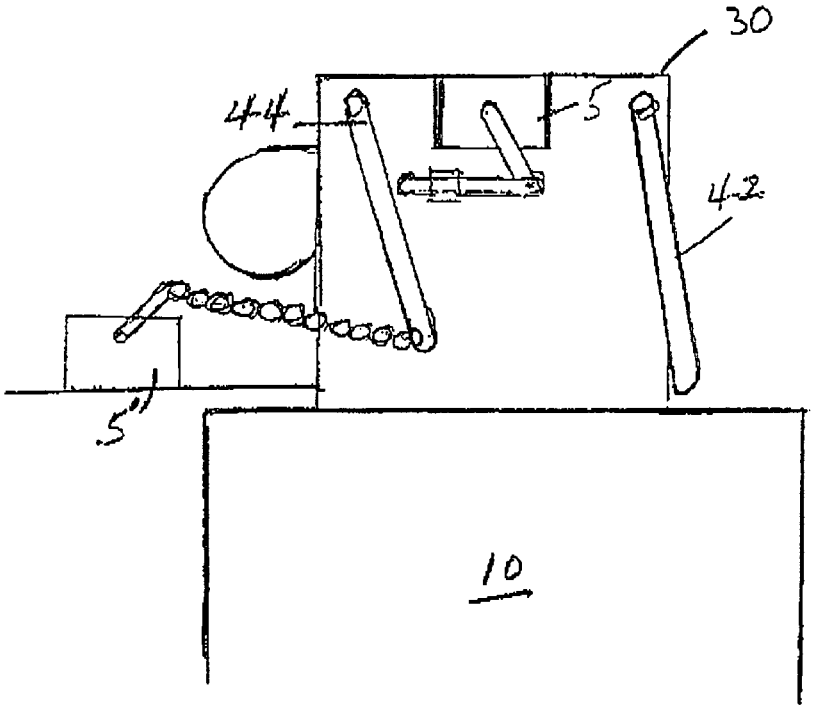
FIG. 16 is a furnace side view, partly in section, with the air box—front door linkage set for the air box configuration of FIG. 10.
Figure 17:
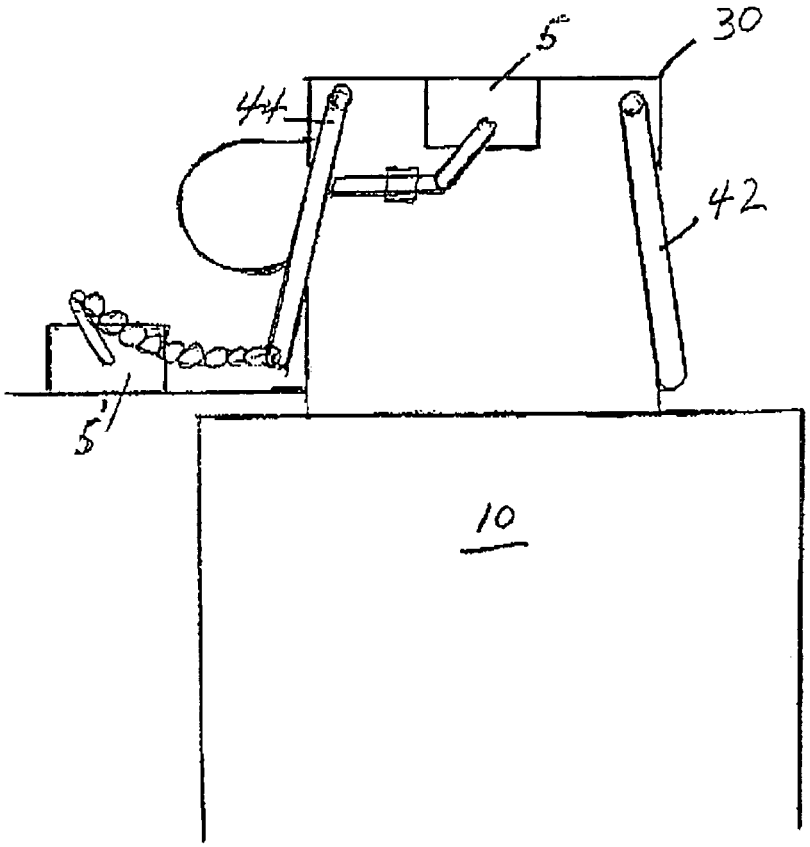
FIG. 17 is a furnace side view, partly in section, with the air box—front door linkage set for the air box configuration of FIG. 11.
Figure 18:
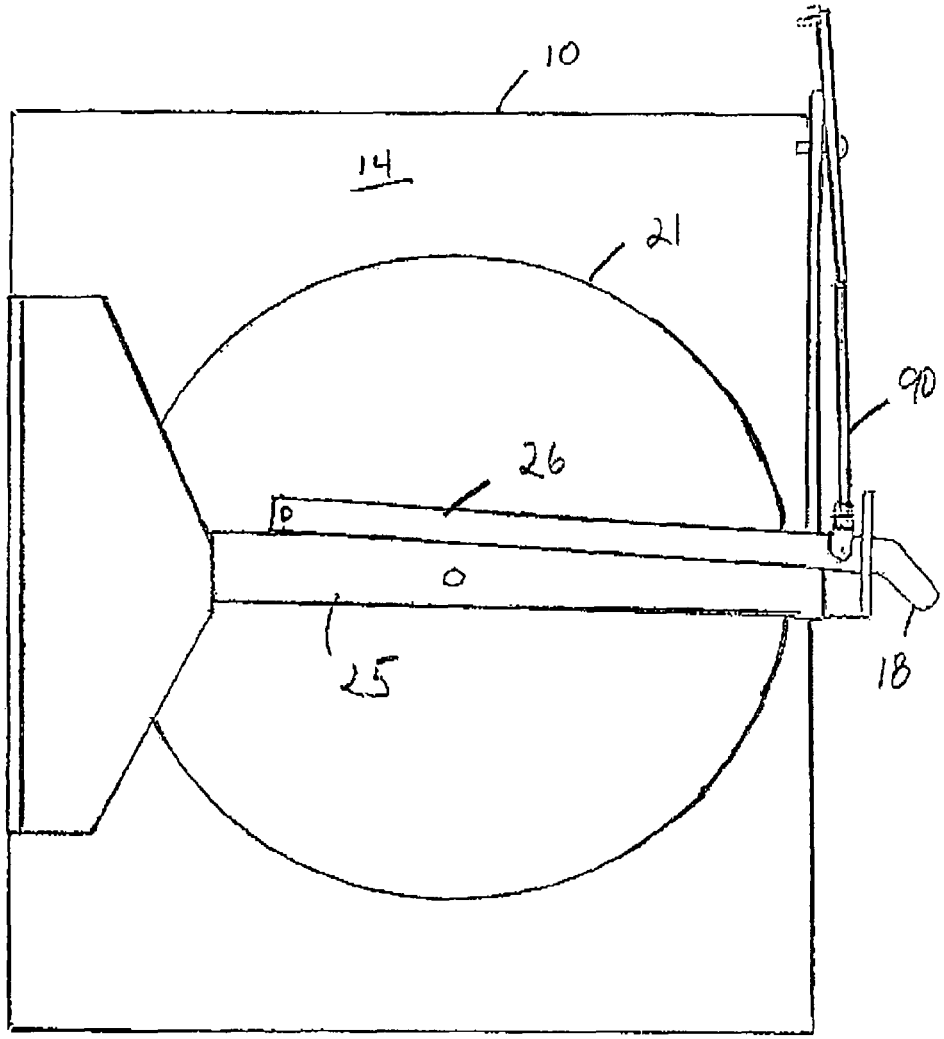
FIG. 18 is a front view of the firebox front door closed.
Figure 19:
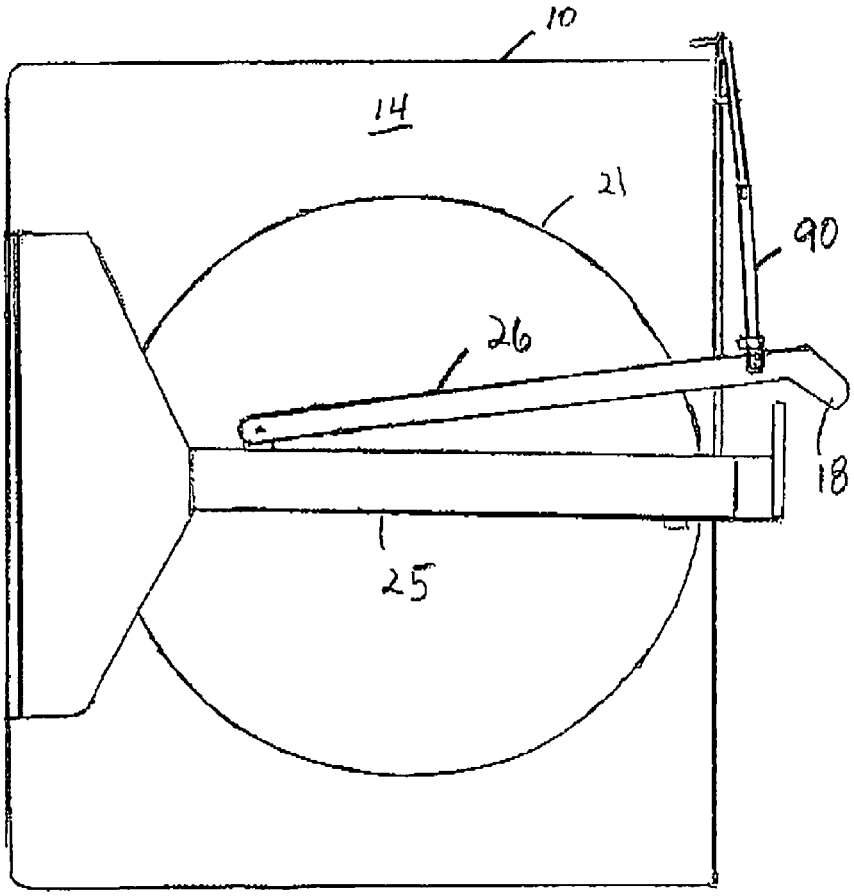
FIG. 19 is a front view of the firebox front door unlocked and about to be opened.

The second damper 43, controlled by the second lever 44, is activated by a thermostat spring return motor 5, adjusting for desired heat levels. See FIGS. 10, 11, 16 and 17. For a power-off situation, a second spring return motor 5' activates closing the second damper 43. See FIGS. 8 and 14. The first damper 41, controlled by the first lever 42, is normally kept in a closed configuration except when the front door 21 of the firebox is opened. A linkage apparatus 90 interconnects the first lever 42 and second lever 44 with the action of the door. When the door is opened the first damper 41 is opened and the second damper 43 is closed. See FIGS. 7, 9, 12 and 15. The front door 21 has a cross bar 25, with an end 18, attached thereto for holding the door closed. An activation rod 26 provides means for attachment to the linkage 90.

To add wood 7 to the wood storage compartment 50, the front door 21 is opened, activating the linkage assembly 90 to close the second damper 43 and open the first damper 41. See FIGS. 9 and 15. After the desired amount of wood 7 is added, the door 21 is closed activating the linkage to open second damper 43 and close the first damper 41. When room temperature rises, the thermostat 5 partially closes the second damper reducing air pressure in the wood storage compartment/primary combustion chamber 50 and reducing the amount of combustion. See FIGS. 11 and 17. When room temperature cools, the thermostat opens the second damper 43 wider, thereby directing more air into the wood storage compartment/primary combustion chamber 50 increasing the amount of combustion. See FIGS. 10 and 16. Through manipulation of the blower and air box dampers specific control of the stove is attained.

The present invention is unique from prior art downdraft furnaces in that the present invention dampers are contained in a self-contained air box separated from and positioned above the furnace body. The invention air blower 3 feeds directly into the air box and not the stove body. The air blower may be manually controlled or controlled by means of a thermostat.

It is understood that the above-described embodiment is merely illustrative of the application. Other embodiments may be readily devised by those skilled in the art which will embody the principles of the invention and fall within the spirit and scope thereof.

I claim:

1. A wood burning furnace, comprising:

a firebox having a top, a bottom, two opposite sides, a front, and a rear, said top, bottom, sides, front and rear defining a firebox interior, said firebox top having an aperture formed therein, said firebox interior being vertically divided into an upper segment and a lower segment separated by a horizontal grate assembly, said interior upper segment comprising a wood storage compartment and primary combustion chamber, and said interior lower segment comprising a secondary combustion chamber, wherein said firebox has a first front aperture opening into the firebox primary combustion chamber, said first front aperture sealable by means of a first door, said first front aperture providing means for inserting fuel logs into the primary combustion chamber;

an air box connected to the firebox top, said air box having a front wall, rear wall, a left side wall, a right side wall, a top, and a bottom, said walls, top and bottom defining a hollow air box interior, said air box bottom being attached to the firebox top, said air box having a plurality of apertures formed therein, one of said plurality of apertures being a first aperture formed in the air box rear wall, said first aperture opening into an up draft exhaust pipe terminating into a furnace exhaust flue, another of said plurality of apertures being a second aperture formed in the air box bottom, said second aperture corresponding to the firebox body top aperture providing fluid access from the air box interior into the firebox interior, another of said plurality of apertures being a third aperture formed in the air box front wall, said third aperture being connected to a combustion air blower providing access for forced air from the combustion air blower into the air box interior and subsequently into and through the primary combustion chamber, and into and through the secondary combustion chamber;

wherein said air box interior is further comprised of a first damper operationally adapted to fit over the air box first aperture, said first damper being connected to a first lever pivotally attached outside the air box to the air box right side wall, a second damper operationally adapted to fit over the air box third aperture, said second damper being connected to a second lever pivotally attached outside the air box to the air box right side wall;

wherein, said second damper, controlled by the second lever, is activated by a first thermostat spring return motor, adjusting for desired heat levels, wherein a second spring return motor is provided and adapted to close second damper when power to the furnace is turned off;

a linkage apparatus interconnecting the first lever and second lever with the first door, said linkage apparatus adapted, upon the door being opened, to open the first damper and close second damper;

a manifold chamber connected to a secondary combustion chamber aperture, near to the firebox bottom, opening from the secondary combustion chamber into the which interconnects the secondary combustion chamber with a furnace heat exchanger having an outlet to said furnace exhaust flue, said manifold chamber adapted to receive forced air from said secondary combustion chamber and passing said forced air through said heat exchanger.

said furnace heat exchanger having a front from which a cylindrical side wall extends horizontally to a rear, said front, side wall and rear defining a heat exchanger interior, said heat exchange interior having a hollow serpentine pipe arrangement, said pipe arrangement having two open ends, said heat exchange front containing a first aperture and a second aperture vertically below said first aperture, wherein one pipe end opens at the first aperture and the other pipe end terminates at and opening out to said second aperture, wherein a second blower is attached to said first aperture blowing air through the pipe and out through the second aperture, said cylindrical side wall having an aperture formed centrally at a vertical highest point, said aperture opening into the exhaust flue, wherein said the heat exchanger has an open connector section interconnecting said manifold chamber with the heat exchange interior, wherein heated air from the secondary combustion chamber, passes through the manifold interior, through the manifold top aperture, through the heat exchange connector section into the heat exchange interior across the pipe and out through the flue, wherein air in the pipe from the second blower is heated and exits the second aperture as heated air.

* * * * *